United States Patent [19]

Diessel et al.

[11] Patent Number: 5,008,032

[45] Date of Patent: Apr. 16, 1991

[54] USE OF PARTIALLY ESTERIFIED COPOLYMERS IN LIQUID DETERGENTS

[75] Inventors: Paul Diessel, Mutterstadt; Johannes Perner, Neustadt; Walter Denzinger, Speyer; Heinrich Hartmann, Limburgerhof; Hans-Juergen Raubenheimer, Ketsch, all of Fed. Rep. of Germany

[73] Assignee: BASF Aktiengesellschaft, Ludwigshafen, Fed. Rep. of Germany

[21] Appl. No.: 417,474

[22] Filed: Oct. 5, 1989

[30] Foreign Application Priority Data

Oct. 31, 1988 [DE] Fed. Rep. of Germany ..... 3837013

[51] Int. Cl.[5] ..... C11D 3/37

[52] U.S. Cl. ..... 252/174.24; 252/156; 252/173; 252/174.23; 252/DIG. 2; 252/DIG. 14

[58] Field of Search ..... 252/174.23, 174.24, 252/DIG. 2, 156, 173, DIG. 14

[56] References Cited

U.S. PATENT DOCUMENTS 3,328,309 6/1967 Grifo et al. ..... 252/137
4,559,159 12/1985 Denzinger et al. ..... 252/174.24

FOREIGN PATENT DOCUMENTS 116930 8/1984 European Pat. Off. .
237075 9/1987 European Pat. Off. .

*Primary Examiner*—Paul Lieberman
*Assistant Examiner*—A. Beadles-Hay
*Attorney, Agent, or Firm*—Oblon, Spivak, McClelland, Maier & Neustadt

[57] ABSTRACT

Liquid, alkaline detergent formulations which contain as essential constituents a surfactant, water and 0.1–20% by weight of partially esterified copolymers are obtainable by the copolymerization of (a) one or more $C_4$–$C_{28}$-olefins and
(b) ethylenically unsaturated dicarboxylic anhydrides of from 4 to 8 carbon atoms in a molar ratio of 1:1 and subsequent partial esterification of the copolymers of the reaction products (A) $C_1$–$C_{30}$-alcohols, $C_8$–$C_{22}$fatty acids, $C_1$–$C_{12}$-alkylphenols or secondary $C_2$–$C_{30}$-amines with
(B) one or more $C_2$–$C_4$-alkylene oxides or tetrahydrofuran in a molar ratio of (A):(B) of from 1:2 to 1:50 and hydrolysis of the anhydride groups of the copolymer to carboxyl groups, the partial esterification of the copolymers being carried on until more than 5 to 50% of the carboxyl groups of the copolymers have been esterified.

13 Claims, No Drawings

USE OF PARTIALLY ESTERIFIED COPOLYMERS IN LIQUID DETERGENTS

EP-B-0,116,930 discloses water-soluble copolymers composed of 40–90% by weight of one or more ethylenically unsaturated monocarboxylic acids of from 3 to 5 carbon atoms and 60–10% by weight of one or more ethylenically unsaturated dicarboxylic acids of from 4 to 8 carbon atoms and/or corresponding dicarboxylic anhydrides, where 2–60% by weight based on the total weight of the carboxylic acids or anhydrides, are esterified with alkoxylated $C_1$–$C_{18}$-alcohols or $C_1$–$C_{12}$-alkylphenols. The partially esterified copolymers and their water-soluble salts are used inter alia in amounts of 0.5–10% by weight in liquid detergent formulations. The compatibility of the partially esterified copolymers of one or more monoethylenically unsaturated monocarboxylic acids and one or more monoethylenically unsaturated dicarboxylic acids is said to be significantly better than that of nonesterified products, so that there are fewer phase separations. However, partially esterified copolymers of the type described are not stable to hydrolysis; they hydrolyze in liquid detergent formulations. This causes inhomogeneities which may even lead to phase separation in the liquid detergent.

EP-A-0,237,075 discloses liquid detergents containing one or more nonionic surfactants in an amount of 5–25% by weight, 2–25% by weight of builder, about 1–10% by weight of $C_4$–$C_{30}$-$\alpha$-olefin/maleic anhydride copolymers as well as water to 100% by weight. It is true that these liquid detergents are initially clear solutions, but they separate relatively quickly on storage.

U.S. Pat. No. 3,328,309 discloses liquid alkaline detergent formulations which besides water and detergents contain 0.1–5%, based on the entire formulation, of a stabilizer comprising a hydrolyzed copolymer of $\alpha,\beta$-unsaturated carboxylic anhydride with a vinyl ester, a vinyl ether or an $\alpha$-olefin in partially esterified form. Suitable alcohol components for the esterification include addition products of alkylene oxides, in particular ethylene oxide on alkylphenols. Only 0.01–5% of carboxyl groups of the copolymer are present in the form of ester groups. It is true that these liquid detergents contain mutually compatible components which remain in solution without separating or clouding, but the primary detergency of this liquid detergent formulation is still in need of improvement.

It is an object of the present invention to provide a polymer for the preparation of the stable liquid detergent formulation which, compared with the prior art liquid detergent formulations, shows improved primary and secondary detergency. A stable liquid detergent formulation for the purposes of the present invention is a liquid detergent formulation whose individual components are mutually compatible and do not separate, even on prolonged storage.

We have found that this object is achieved by using a partially esterified copolymer obtainable by copolymerizing (a) one or more $C_4$–$C_{28}$-olefins or a mixture of one or more $C_4$–$C_{28}$-olefins with up to 20 mol % of $C_1$–$C_{28}$-alkyl vinyl ethers and (b) an ethylenically unsaturated dicarboxylic anhydride of from 4 to 8 carbon atoms in a molar ratio of 1:1 to give a copolymer having a K value of from 6 to 100 (determined by the method of H. Fikentscher in tetrahydrofuran at 25° C. and a polymer concentration of 1% by weight) and subsequent partial esterification of the copolymer with a reaction product of (A) a $C_1$–$C_{30}$-alcohol, a $C_8$–$C_{22}$-fatty acid, a $C_1$–$C_{12}$-alkyl-phenol, a secondary $C_2$–$C_{30}$-amine or a mixture thereof with (B) one or more $C_2$–$C_4$-alkylene oxides or tetrahydrofuran in a molar ratio of (A):(B) of from 1:2 to 1:50 and hydrolysis of the anhydride groups of the copolymer to carboxyl groups, and the partial esterification of the copolymer being carried on until more than 5–50% of carboxyl groups of the copolymer are esterified, or a salt thereof, as a liquid detergent additive in an amount of from 0.1 to 20% by weight.

The liquid detergent which contains the partially esterified copolymer to be used according to the present invention produces on mixing with an aqueous alkaline solution of an anionic or nonionic surfactant a clear aqueous solution which is stable to storage. This formulation shows improved primary and secondary detergency compared with similar liquid detergents of the prior art.

The partially esterified copolymer to be used according to the present invention is prepared for example by first copolymerizing (a) one or more $C_4$–$C_{28}$-olefins or a mixture of one or more $C_4$–$C_{28}$-olefins with up to 20 mol % of a $C_1$–$C_4$-alkyl vinyl ether and (b) an ethylenically unsaturated dicarboxylic anhydride of from 4 to 8 carbon atoms in a molar ratio of 1:1. A suitable component (a) is for example isobutylene, octene, decene, dodecene, tetradecene, hexadecene, heptadecene, octadecene or a mixture thereof. Of the olefins mentioned, not only the olefins having a terminal double bond are suitable but also isomers. Preference is given to using as component (a) a branched $C_6$–$C_{18}$-olefin or a mixture of such olefins. Particular preference is given to using a mixture of 2,4,4'-trimethyl-1-pentene and2,4,4'-trimethyl-2-pentene as component (a) of the copolymer.

The isomeric trimethylpentenes mentioned can be used in the copolymerization in any desired ratio. A particularly preferred mixture of these olefins contains from 35 to 45 mol % of 2,4,4'-trimethyl-1-pentene and from 5 to 15 mol % of 2,4,4'-trimethyl-2-pentene. Terpolymers which contain trimethylpentenes with maleic anhydride as copolymerized units are known for example from EP Patents 9169 and 9170. The said olefins of from 4 to 28 carbon atoms may also be copolymerized mixed with a $C_1$–$C_{28}$-alkyl vinyl ether, for example methyl vinyl ether, ethyl vinyl ether, n-propyl vinyl ether or isobutyl vinyl ether. The proportion of alkyl vinyl ether in the mixture with one or more suitable olefins is up to 20 mol %. For example, component (a) can be a mixture of 80 mol % of diisobutylene and 20 mol % of methyl vinyl ether.

A suitable component (b) for preparing the copolymer is a monoethylenically unsaturated dicarboxylic anhydride of from 4 to 8 carbon atoms, e.g. maleic anhydride, itaconic anhydride, mesaconic anhydride, citraconic anhydride or methylenemalonic anhydride. Of the anhydrides mentioned, maleic anhydride and itaconic anhydride are preferred, with maleic anhydride being particularly important in practice. The copolymerization of monomers (a) and (b) produces an alternating copolymer which contains the monomers mentioned as copolymerized units in a molar ratio of 1:1.

The K value of the copolymer is 6–100, preferably 8–40 (measured by the method of H. Fikentscher at 25° C. in tetrahydrofuran and a polymer concentration of 1% by weight). The copolymerization of monomers (a) and (b) is carried out in a conventional manner, for example as a solution polymerization in a polar solvent which is inert to anhydrides, such as acetone, tetrahydrofuran or dioxane, as a precipitation polymerization in toluene, xylene or an aliphatic hydrocarbon, or else as mass polymerization of components (a) and (b), in which case it is advantageous to use an excess of monomer of component (a) as diluent. In any case the polymerization is started by means of a polymerization initiator. Suitable polymerization initiators here are all free radical compounds, for example peroxides, hydroperoxides, redox initiators and azo compounds. The copolymer thus obtainable is subsequently partially esterified and hydrolyzed, so that the anhydride groups are converted into carboxyl groups. It is also possible first to hydrolyze the anhydride groups of the copolymer, so that all the anhydride groups are converted into carboxyl, and then to esterify in a conventional manner. However, preference is given to first partially esterifying the carboxylic anhydride groups of the copolymer with the reaction product of (A) and (B).

Suitable compounds (A) are $C_1$–$C_{30}$-alcohols, e.g. methanol, ethanol, n-propanol, isopropanol, n-butanol, isobutanol, tert-butanol, pentanol, cyclohexanol, n-hexanol, n-octanol, 2-ethylhexanol, decanol, dodecanol or stearyl alcohol. Of particular industrial significance are the oxo alcohols, e.g. $C_{10}$-alcohols, $C_{13}$-alcohols and $C_{13}/C_{15}$-alcohols, and also natural alcohols, e.g. $C_{16}/C_{18}$-tallow fat alcohols. These oxo alcohols and the natural alcohols are as a general rule mixtures of more than one alcohol.

Suitable compounds (A) also include $C_8$–$C_{22}$-fatty acids, e.g. stearic acid, palmitic acid, coconut fatty acid, tallow fatty acid, lauric acid or behenic acid. Suitable components (A) also include $C_1$–$C_{12}$-alkylphenols, e.g. n-decylphenol, n-nonylphenol, isononylphenol, n-octylphenol, isobutylphenol or methylphenol. Component (A) may also be a secondary $C_2$–$C_{30}$-amine, e.g. dimethylamine, di-n-butylamine, di-n-octylamine or distearylamine. Preference is given to using a secondary $C_8$–$C_{18}$-fatty amine. Preferred components (A) are $C_1$–$C_{30}$-alcohols and secondary $C_2$–$C_{18}$-amines.

A suitable component (B) is a $C_2$–$C_4$-alkylene oxide, e.g. ethylene oxide, propylene oxide, n-butylene oxide or isobutylene oxide. It is also possible to use tetrahydrofuran as component (B). The preferred compounds for use as component (B) are ethylene oxide and propylene oxide. Ethylene oxide and propylene oxide may be added to the compound indicated under (A) either alone or in the form of a mixed gas to form an adduct composed of random ethylene oxide and propylene oxide units, or else by adding first ethylene oxide and then propylene oxide to the compound mentioned under (A), or vice versa, or indeed by adding first ethylene oxide, then propylene oxide then again ethylene oxide to a compound (A) to form block copolymers. Techniques of the alkoxylation of compounds (A) are known.

A compound (A) is reacted with a compound (B) in a molar ratio of (A):(B) of from 1:2 to 1:50, preferably from 1:3 to 1:12. This reaction produces in all cases a reaction product where at least one end group is an OH group. The reaction product thus prepared from (A) and (B) is made to react with the above-described copolymer of monomers (a) and (b) to form a partially esterified copolymer. This reaction can be carried out in the presence of a solvent which is inert to carboxylic anhydride groups, e.g. acetone or tetrahydrofuran, but preferably is carried out in the presence of a solvent; that is the copolymer which contains olefin/dicarboxylic anhydride groups is reacted directly with the reaction product of (A) and (B). The amount of reactant used here is chosen in such a way that only partial esterification of the anhydride groups occurs. Based on the hydrolyzed partially esterified polymer, more than 5%, e.g. 5.5–50%, preferably 9–30%, of the carboxyl groups are esterified. The esterification itself is in general carried out at an elevated temperature, for example at from 50 to 200° C., preferably 80°–150° C., in the presence of a customary esterification catalyst. A particularly suitable catalyst is p-toluenesulfonic acid. The esterification reaction ends after about 0.5–20, preferably 1–10, hours. Suitable solvents for the esterification reaction, if a solvent is used at all, are all those organic liquids which are inert toward anhydride groups and which dissolve or swell not only the starting materials but also the partially esterified copolymer, e.g. toluene, xylene, ethylbenzene, aliphatic hydrocarbons and ketones, such as acetone or methyl ethyl ketone. After the partial esterification, the solvent, if any was used, is removed from the reaction mixture, for example by distillation, and the remaining partially esterified copolymer is dissolved in water by the addition of alkali. On addition of the alkali, the anhydride groups still present in the copolymer are hydrolyzed. Suitable alkalis are for example sodium hydroxide solution, potassium hydroxide solution, ammonia, amines and alkanolamines. The pH of the resulting aqueous partially esterified copolymer solution is 4–10, preferably 6–8.

The partially esterified copolymer to be used according to the present invention is also obtainable for example by partially transesterifying a $C_1$–$C_3$-alkyl monoester or diester of the monoethylenically unsaturated dicarboxylic acid (component (b) with the above-described reaction product of (A) and (B) and then copolymerizing the transesterified product with one or more $C_4$–$C_{28}$-olefins or a mixture of one or more $C_4$–$C_{28}$-olefins with up to 20 mol % of a $C_1$–$C_4$-alkyl vinyl ether. The reaction of the monoester or diester of the monoethylenically unsaturated dicarboxylic acid with the reaction product of (A) and (B) is carried on only to such a degree that at least 5–50% of the ester groups derived from a $C_1$–$C_3$-alcohol react. After the copolymerization, the copolymer is reacted with an alkali, ammonia or an alkanolamine to form a water-soluble salt with at least partial hydrolysis of the starting monoester or diester of a $C_1$–$C_3$-alcohol. However, the partial esterification of an anhydride group containing alternating copolymer of (a) and (b) with a reaction product of (A) and (B) is always preferred.

The copolymer to be used according to the present invention is also obtainable by copolymerization of (a) one or more $C_4$–$C_{28}$-olefins or a mixture of one or more $C_4$–$C_{28}$-olefins with up to 20 mol % of $C_1$–$C_{28}$-alkyl vinyl ether and (b) a reaction product of (b1) ethylenically unsaturated dicarboxylic anhydride of from 4 to 8 carbon atoms and (b2) a reaction product of (A) a $C_1$–$C_{30}$-alcohol, a $C_8$–$C_{22}$-fatty acid, a $C_1$–$C_{12}$-alkyl phenol or a secondary $C_2$–$C_{30}$-amine with (B) one or more $C_2$–$C_4$-alkylene oxides or tetrahydrofuran in a molar ratio of (A):(B) of from 1:2 to 1:50, so that more than 5–50% of the anhydride groups are esterified, in a molar ratio of (a):(b) of 1:1 to give a copolymer having a K value of from 6 to 100, and hydrolysis of the unconverted anhydride groups of the copolymer to carboxyl groups or salts thereof.

The partially esterified copolymer to be used according to the present invention can be present in the form of the free acid and in a partially or completely neutralized form and may be added to the liquid detergent in either of these forms. The liquid detergent formulation which contains the above-described partially esterified copolymer in an amount of from 0.1–20, preferably 1–10% by weight, is usually alkaline and contains as a further essential constituent one or more anionic surfactants, one or more nonionic surfactants, or a mixture thereof, as well as water. The formulation in question here is a clear aqueous solution. Suitable anionic surfactants are for example sodium alkylbenzenesulfonates, fatty alcohol sulfates and fatty alcohol polyglycol ether sulfates. Individual compounds of this kind are for example $C_8$–$C_{12}$-alkylbenzenesulfonates, $C_{12}$–$C_{16}$-alkanesulfonates, $C_{12}$–$C_{16}$-alkyl sulfates, $C_{12}$–$C_{16}$-alkyl sulfosuccinates and sulfated ethoxylated $C_{12}$–$C_{16}$-alkanols. Suitable anionic surfactants also include sulfated fatty acid alkanolamines, fatty acid monoglycerids or reaction products of from 1 to 4 moles of ethylene oxide with primary or secondary fatty alcohols or alkylphenols. Other suitable anionic surfactants are fatty acid esters or amides of hydroxy- or amino-carboxylic or -sulfonic acids, for example fatty acid sarcosides, glycolates, lactates, taurides or isethionates. The anionic surfactants may be present in the form of the sodium, potassium and ammonium salts and as soluble salts of organic bases, such as monoethanolamine, diethanolamine or triethanolamine or of other substituted amines. The anionic surfactants also include the soaps, i.e. the alkali metal salts of natural fatty acids.

Usable nonionic surfactants, or nonionics for short, are for example addition products of from 3 to 40, preferably from 4 to 20, moles of ethylene oxide to 1 mole of fatty alcohol, alkylphenol, fatty acid, fatty amine, fatty acid amide or alkanesulfonamide. Of particular importance are the addition products of from 5 to 16 moles of ethylene oxide to coconut or tallow fatty alcohol, to oleyl alcohol or to synthetic alcohols of from 8 to 18, preferably from 12 to 18, carbon atoms, and also to mono- or dialkylphenols having from 6 to 14 carbon atoms in the alkyl moieties. However, besides these water-soluble nonionics it is also possible to use water-insoluble or partially water-soluble polyglycol ethers having from 1 to 4 ethylene glycol ether moieties in the molecule, in particular if used together with water-soluble nonionics or anionics.

Other useful nonionic surfactants are the water-soluble addition products of ethylene oxide to a polypropylene glycol ether, an alkylenediaminopolypropylene glycol or an alkylpolypropylene glycol having from 1 to 10 carbon atoms in the alkyl chain which contain from 20 to 250 ethylene glycol ether groups and from 10 to 100 propylene glycol ether groups and in which the polypropylene glycol ether chain acts as a hydrophobic moiety.

It is also possible to use nonionic surfactants of the type of the amine oxides or sulfoxides.

The foaming power of a surfactant can be increased or reduced by combining suitable surfactant types. A reduction is likewise possible by adding non-surfactant-like organic substances.

The liquid aqueous detergent contains from 10 to 50% by weight of surfactant. This may be an anionic or nonionic surfactant. However, it is also possible to use a mixture of an anionic and a nonionic surfactant. In such a case, the level of anionic surfactant in the liquid detergent is selected within the range from 10 to 30% by weight and the level of nonionic surfactant in the liquid detergent is selected in the range from 5 to 20% by weight, based on the total detergent formulation.

The liquid detergent contains as an essential component the partially esterified copolymer to be used according to the present invention, in an amount of from 0.1 to 20, preferably from 1 to 10, % by weight, as well as often in amounts of from 10 to 60, preferably from 20 to 50, % by weight.

The liquid detergent may also contain further, modifying ingredients. They include for example alcohols, such as ethanol, n-propanol or isopropanol. These compounds, if they are used at all, are used in amounts of from 3 to 8% by weight, based on the total detergent formulation. The liquid detergent may also contain hydrotropes. These are compounds such as 1,2-propanediol, cumenesulfonate and toluenesulfonate. If such compounds are used for modifying the liquid detergent, their amount, based on the total weight of the liquid detergent, is from 2 to 5% by weight. In many cases, the addition of a complexing agent modifier has also proved advantageous. Complexing agents are for example ethylenediaminetetraacetic acid, nitrilotriacetate and isoserine diacetic acid. Complexing agents are used in amounts of 0 to 10% by weight, based on the liquid detergent. The liquid detergent may also contain citrates, di- or triethanolamine, turbidifiers, fluorescent whitening agents, enzymes, perfume oils and dyes. These ingredients, if used at all, are present in amounts of up to 5% by weight. The liquid detergent according to the present invention is preferably phosphate-free. However, it may also contain phosphates, e.g. pentasodium triphosphate and/or tetrapotassium pyrophosphate. If phosphates are used, the phosphate content of the total formulation of the liquid detergent is from 10 to 25% by weight.

The above-described liquid detergent has the advantage over pulverulent detergents of being easily meterable and of showing very good grease and oil dissolving power at lower wash temperatures. Liquid detergent compositions contain large amounts of active detergent substances which remove the soil from the textile fabric at wash temperatures as low as 40°–60° C. The dispersing properties of polymers have hitherto not been utilizable in aqueous liquid detergents since, as a consequence of the high electrolyte concentrations in the detergents, it has been impossible to obtain stable solutions with polymers. Using the partially esterified copolymer according to the present invention it has now become possible to preparestable aqueous solutions of detergents and to obtain a significant improvement in the wash properties of the liquid detergents. The effectiveness in a liquid detergent of the partially esterified copolymer to be used according to the present invention is demonstrated in the Examples by the stability of the liquid detergent and by primary and secondary detergency performance. Primary detergency is a measure of the ability of a detergent to remove soil from a textile material. Soil removal in turn is measured as the difference in whiteness between the unwashed and the washed textile material after a wash. The textile material used is a cotton, cotton/polyester or polyester fabric with standard soiling. After every wash the whiteness of the fabric is determined as % reflectance in an Elrepho photometer from Zeiss.

Secondary detergency is a measure of the ability of a detergent to prevent redeposition of the dislodged soil on the fabric in the wash liquor. A lack of secondary detergency would only become noticeable after several washes, e.g. 3, 5, 10 or even only after 20, washes by increasing grayness, i.e. the redeposition of soil from the wash liquor on the fabric. To determine the grayness tendency, standard soiled fabrics are repeatedly washed together with a white test fabric with the soiled fabric being renewed after every wash. The soil dislodged from the soiled fabric and deposited on the white test fabric in the course of the wash causes a measurable drop in whiteness. The partially esterified copolymer, or a water-soluble salt thereof, to be used according to the invention in a liquid detergent can also be used for formulating pulverulent detergent compositions.

The percentages in the Examples are percent by weight. The K values were determined by the method of H. Fikentscher, Cellulose Chemie 13 (1932), 58–64, 71–74. The K values of the copolymers which contain anhydride groups were determined in tetrahydrofuran at 25° C. and a polymer concentration of 1% by weight. The K values of the hydrolyzed copolymers were determined in aqueous solution at 25° C., a pH of 7.5 and a polymer concentration of 1% by weight.

Preparation of the partially esterified copolymer to be used according to the present invention

COPOLYMER 1

A polymerization reactor equipped with a stirrer, a thermometer, a condenser, a nitrogen inlet, a nitrogen outlet and metering means is charged with 550 g of n-dodecene and 98 g of maleic anhydride, and the contents are heated to 100° C. in a slow stream of nitrogen. As soon as a temperature of 100° C. is reached, a solution of 5 g of tert-butyl perethylhexanoate in 34 g of dodecene is added as initiator over 3 hours, and subsequently the reaction mixture is maintained at 100° C. for a further 2 hours. A clear solution of copolymer in dodecene is obtained. Unconverted dodecene is distilled off under reduced pressure, leaving 266 g of a copolymer of n-dodecene and maleic anhydride of K 10.7.

266 g of the copolymerization product are reacted with 104.4 g of an addition product of 7 mol of ethylene oxide to 1 mol of a $C_{13}/C_{15}$-oxo alcohol in the presence of 0.275 g of a p-toluenesulfonic acid at 150° C. over 4 hours. The reaction mixture is then cooled down to 100° C. and worked up by the simultaneous addition of 250 g of water and 83 g of 50% strength aqueous potassium hydroxide solution to an aqueous solution. After water and the potassium hydroxide solution have been added, the reaction mixture is stirred at 55°–60° C. for 2 hours. A pale brown viscous solution forms, having a solids content of 56.2%. The pH of this solution is 7.3. The K value of the dissolved copolymer is 27.9. 10% of the carboxyl groups are esterified in the course of the reaction.

COPOLYMER 2

The above-described polymerization reactor, which is also designed for work under superatmospheric pressure, is charged with 980 g of maleic anhydride, 1,440 g of xylene and 14 g of polyvinyl ethyl ether of K 50 (determined on a 1% strength solution in cyclohexanone). The reactor is then tightly sealed and pressurized with nitrogen to 10 bar. Immediately thereafter the reactor is depressurized. The pressurization with nitrogen is repeated two more times. Thereafter the reactor contents are heated to 140° C., 600 g of isobutene are metered in over 3 hours, a solution of 46 g of tert-butyl perethylhexanoate and 31 g of di-tert-butyl peroxide in 100 g of xylene is metered in over 4 hours from the time of getting to 140° C., and, following this addition of initiator, the reaction mixture is heated at 140° C. for a further hour. During the reaction, the maximum autogenous pressure is 8 bar. After the reaction has ended, the reaction mixture is carefully depressurized, and the xylene used as solvent is distilled off. Thereafter the hot melt, at 150° C., is emptied onto a metal sheet, where it solidifies into a brown, brittle resin which has a K value of 9.7.

308 g of the isobutene and maleic anhydride copolymer thus prepared are then partially esterified with 208.8 g of the reaction product of 7 mol of ethylene oxide with one mol of a $C_{13}/C_{15}$-oxo alcohol in the presence of 0.31 g of p-toluenesulfonic acid at 150° C. in the course of 4 hours with stirring. The reaction mixture is then cooled down to 100° C. and turned into a solution by the addition of 375 g of water and 185 g of a 50% strength aqueous potassium hydroxide solution and subsequent stirring at 50°–60° C. for 2 hours, the resulting solution being brown and viscous having a solids content of 43.8%. The pH is 7.1. The K value of the partially esterified copolymer is 28.9. 10% of the carboxyl groups are esterified.

COPOLYMER 3

The reactor described in Example 1 is charged with 1507.3 g of diisobutene (isomeric mixture of 80% of trimethyl-1-pentene and 20% of trimethyl-2-pentene), 630 g of maleic anhydride and 5.4 g of polyvinyl ethyl ether of K 50 (measured in 1% strength solution in cyclohexanone), and the contents are heated to the boil. Half a solution of 30 g of tert-butyl perethylhexanoate in 100 parts of diisobutene is added over 2 hours, followed by the other half of the solution added in the course of 1 hour. After this addition of initiator, the reaction mixture is heated at the boil for a further 2 hours. The finely granular suspension of copolymer is then filtered off and dried at 60° C. in a rotary evaporator under a pressure of 20 mbar. 1,350 g are obtained of a fine white powder which has a K value of 36.

420 g of the diisobutene/maleic anhydride copolymer thus prepared are reacted with 159.6 g of an addition product obtainable by reacting 5 mol of propylene oxide and then 2.5 mol of ethylene oxide with one mole of $C_{13}/C_{15}$-oxo alcohol. In the partial esterification, 0.42 g of p-toluenesulfonic acid is used as catalyst and 362 g of toluene are used as diluent. This reaction mixture is refluxed for 12 hours. The toluene is then distilled off, leaving 320 g of a pale yellow brittle resin, which is dissolved in a solution of 152 g of potassium hydroxide in 300 g of water at 80° C. The partially esterified copolymer forms a highly viscous solution, which is sufficiently diluted with water until readily stirrable. The clear, slightly yellow solution thus obtained has a solids content of 27.6% and a pH of 7.1. The K value of the partially esterified copolymer is 47.5. 6.5% of the carboxyl groups of the hydrolyzed copolymer are esterified.

COPOLYMERS 4 TO 13

The reactor described in Example 1, which is operated under superatmospheric pressure, is charged in each case with 1,082 g of diisobutylene (isomer mixture of 80% of trimethyl-1-pentene and 20% of trimethyl-2-pentene) and 49 g of maleic anhydride. The reactor is then tightly sealed and pressurized with 6 bar of nitrogen. The reactor is then depressurized and then repressurized twice with 6 bar of nitrogen as described. Thereafter the reactor contents are heated to 160° C. with stirring. 931 g of maleic anhydride are then metered in over 2 hours, and a solution of 63 g of di-tert-butyl peroxide in 150 g of diisobutene is added over 3 hours. After this addition of initiator, the reaction mixture is stirred at 160° C. for 1 hour. 246 g of unconverted diisobutene are then distilled off under a pressure of 100 mbar. The clear golden yellow melt thus obtainable is emptied onto a metal sheet to form, on cooling to room temperature, a brittle resin which has a K value of 12.6. 420 g of this resin are then reacted for 4 hours at 150° C. in the presence of 0.8 g of p-toluenesulfonic acid with the amount of alkoxylated compound indicated for each Example in Table 1, which also shows details of the alkoxylated compound obtained by reacting (A) with alkylene oxide (B). Thereafter the anhydride groups of the partially esterified copolymer are hydrolyzed and the free acid groups are neutralized by dissolving the reaction product in the amount of KOH and water indicated for each Example in Table 1. In every case the result is a clear aqueous solution of the potassium salt of the partially esterified copolymer.

TABLE 1

| Copolymer | Proportion of esterified COOH groups [%] | Alkoxylated Amount [g] | compound obtainable by alkoxylation of 1 mol of (A) with . . . mole of (B) | $H_2O$ [g] | KOH 50% [g] | Solids content of aqueous solution | pH | K value of end product |
|---|---|---|---|---|---|---|---|---|
| 4 | 10 | 173.6 | $C_{13}/C_{15}$-oxo alcohol 5 EO[1] | 380 | 211 | 43.8 | 7.1 | 15.3 |
| 5 | 10 | 208.8 | $C_{13}/C_{15}$-oxo alcohol 7 EO | 420 | 218 | 49.3 | 7.2 | 14.8 |
| 6 | 10 | 261.6 | $C_{13}/C_{15}$-oxo alcohol 10 EO | 420 | 232 | 54.4 | 7.2 | 14.3 |
| 7 | 12.5 | 261 | $C_{13}/C_{15}$-oxo alcohol 7 EO | 300 | 205 | 62.2 | 7.2 | 14.3 |
| 8 | 25 | 522 | $C_{13}/C_{15}$-oxo alcohol 7 EO | 400 | 149 | 59.4 | 7.6 | 15.0 |
| 9 | 10.3 | 228 | $C_{13}$-oxo alcohol 8 EO | 400 | 223 | 50.2 | 7.0 | 13.8 |
| 10 | 32.5 | 611 | $C_{10}$-oxo alcohol 7 EO | 800 | 170 | 52.5 | 7.0 | 12.8 |
| 11 | 10 | 314.8 | fatty amine 12 EO | 450 | 178 | 40.7 | 8.4 | 11.7 |
| 12 | 10 | 276.8 | methanol 15 EO | 430 | 178 | 49.0 | 7.0 | 12.6 |
| 13 | 10 | 220 | $C_{12}/C_{14}$-oxo alcohol 8 EO | 400 | 213 | 53.1 | 7.1 | 13.7 |

[1]EO = ethylene oxide

EXAMPLE 14

In a reactor as described in Example 1, which may be operated under superatmospheric pressure, 196 g of maleic anhydride, 0.42 g of p-toluenesulfonic acid and 228 g of reaction product of a $C_{13}$-oxo alcohol with 8 mol of ethylene oxide are heated to 150° C. After 4 hours at 150° C. the reactor is tightly sealed, pressurized three times with 6 bar of nitrogen and charged with 224 g of diisobutene (isomer mixture of 80% of trimethyl-1-pentene and 20% of trimethyl-2-pentene), the result being an autogenous pressure of 8 bar. A solution of 12.5 g of ditert-butyl peroxide and 50 g of diisobutene is then metered in over 4 hours, and the reaction mixture is subsequently heated at 150° C. for 1 hour. It is then carefully pressurized, and the last traces of unconverted diisobutene are distilled off under reduced pressure. The residue is cooled down to 90° C., 400 g of water and 222 g of 50% strength aqueous potassium hydroxide solution are metered in over 0.5 hours, and the mixture subsequently heated at 60° C. for 2 hours. The yellow solution obtained has a solids content of 54.3%. The K value of the end product is 15.9.

APPLICATION EXAMPLES

The above-described copolymers 1 to 14 were tested in the following liquid detergent formulation:

20% of the reaction product of 1 mol of a $C_{13}/C_{15}$-oxo alcohol and 7 mol of ethylene oxide
10% of sodium dodecylbenzenesulfonate, 50% strength in water
10% of coconut fatty acid
5% of triethanolamine
6% of copolymer (calculated as 100%)
Water to 100%

The tests were also carried out, to obtain a comparison with the prior art, on a copolymer-free detergent formulation and on a detergent formulation which contained 6% of a maleic anhydride/diisobutene copolymer of K 12.6 as potassium salt.

The primary detergency was determined under the following conditions:

| | |
|---|---|
| Soil removal, whiteness | % reflectance |
| Washing machine simulator | Launder-O-meter |
| Wash temperature | 60° C. |
| Water hardness | 3 mmol of $Ca^{2+}/l$ = 16.8° of German hardness |
| Ratio of Ca:Mg | 3:2 |
| Washing time | 30 minutes |
| Number of wash cycles: | 1 |
| Detergent concentration | 6 g of detergent composition per liter |
| Liquor ratio | 25:1 |
| Fabrics | WFK[1] 20 D (polyester/cotton) |

-continued

| | EMPA[2] 104 (polyester/cotton) |
|---|---|
| Whiteness measurement in Elrepho in % reflectance | |
| Whiteness of unwashed fabrics: | |
| WFK 20 D | 40.5 |
| EMPA 104 | 13 |

[1]WFK = Wachereiforschung Krefeld, West Germany
[2]EMPA = Eidgenosisches Materialprufamt, St. Gallen, Switzerland Secondary detergency, which is a measure of grayness inhibition on the fabric, was determined as follows:

| | |
|---|---|
| Washing machine simulator | Launder-O-meter |
| Wash temperature | 60° C. |
| Water hardness | 3 mmol of $Ca^{2+}/l$ = 18° of German hardness |
| Ratio of Ca:Mg | 3:2 |
| Washing time | 30 minutes |
| Number of wash cycles: | 1 |
| Detergent concentration | 6 g of detergent composition per liter |
| Liquor ratio | 14:1 |
| Fabric | cotton/polyester fabric, polyester fabric, WFK soiled fabric (replaced after every wash) |
| Whiteness measurement in Elrepho in % reflectance | |
| Whiteness of unwashed fabric: | |
| Cotton/polyester | 72 |
| Polyester | 74 |

The stability of each liquid detergent formulation and the primary detergency and secondary detergency performances obtainable with these formulations are shown in Table 2.

We claim:

1. A liquid, alkaline detergent formulation, containing as essential constituents:

(1) about 10 to 50% by weight of one or more anionic surfactants, one or more nonionic surfactants or a mixture thereof, (2) 0.1–20% by weight of a partially esterified copolymer obtainable by copolymerization of (a) one or more $C_4$–$C_{28}$-olefins or a mixture of one or more $C_4$–$C_{28}$-olefins with up to 20 mol % of a $C_1$–$C_{28}$-alkyl vinyl ether and (b) an ethylenically unsaturated dicarboxylic anhydride of from 4 to 8 carbon atoms in a molar ratio of 1:1 to give a copolymer having a K value of from 6 to 100 (determined by the method of H. Fikentscher in tetrahydrofuran at 25° C. and a polymer concentration of 1% by weight) and subsequent partial esterification of the copolymer with a reaction product of (A) a $C_1$–$C_{30}$-alcohol, a $C_8$–$C_{22}$-fatty acid, a $C_1$–$C_{12}$-alkyl-phenol, a secondary $C_2$–$C_{30}$-amine or a mixture thereof with (B) one or more $C_2$–$C_4$-alkylene oxides or tetrahydrofuran in a molar ratio of (A):(B) of from 1:2 to 1:50 and hydrolysis of the anhydride groups of the copolymer to carboxyl groups, the partial esterification of the copolymer being carried on until more than about 9% of the carboxyl groups of the copolymer have been converted, and (3) water.

2. The liquid, alkaline detergent formulation as claimed in claim 1, wherein the partially esterified copolymer is prepared by first copolymerizing:

(a) a branched $C_6$–$C_{18}$-olefin or a mixture of branched $C_6$–$C_{18}$-olefins and

TABLE 2

Stability and primary and secondary detergency performance of detergent formulations

| Example No. | Copolymer | Stability at room temperature (23° C.) after 1 day | 1 week | 4 weeks | Primary detergency % reflectance WFK 20 D fabric | EMPA 104 fabric | Secondary detergency % reflectance cotton/polyester | polyester |
|---|---|---|---|---|---|---|---|---|
| 1 | 1 | + | + | + | 56.0 | 25.0 | 68.5 | 45.0 |
| 2 | 2 | + | + | + | 54.5 | 25.6 | 67.5 | 45.5 |
| 3 | 3 | + | + | + | 56.5 | 26.0 | 65.0 | 46.0 |
| 4 | 4 | + | + | + | 56.5 | 26.5 | 68.5 | 45.0 |
| 5 | 5 | + | + | + | 56.0 | 27.5 | 70.0 | 45.5 |
| 6 | 6 | + | + | + | 54.0 | 24.5 | 62.0 | 44.0 |
| 7 | 7 | + | + | + | 57.0 | 27.0 | 71.0 | 50.0 |
| 8 | 8 | + | + | + | 56.5 | 26.5 | 69.5 | 47.0 |
| 9 | 9 | + | + | + | 55.8 | 25.5 | 69.0 | 46.0 |
| 10 | 10 | + | + | + | 54.5 | 24.7 | 63.0 | 44.5 |
| 11 | 11 | + | + | + | 55.0 | 25.0 | 60.0 | 45.0 |
| 12 | 12 | + | + | + | 57.0 | 25.4 | 67.0 | 44.5 |
| 13 | 13 | + | + | + | 57.0 | 26.5 | 66.0 | 45.0 |
| 14 | 14 | + | + | + | 53.5 | 24.5 | 63.0 | 44.0 |
| Comparative Example 1 | none | + | + | + | 46.0 | 23.0 | 55.0 | 43.0 |
| Comparative Example 2 | copolymer of MA/DIB | – | – | – | 52.0 | 23.5 | 60.0 | 43.5 |

+ = stable
– = unstable
Comparative Example 2 features a maleic anhydride (MA) and diisobutene (DIB) copolymer of K 12.6 as potassium salt As Table 2 clearly reveals, use of the partially esterified copolymer according to the invention yields a liquid detergent which is stable to storage and which gives a better primary and secondary detergency performance than a hydrolyzed, nonesterified copolymer of maleic anhydride and diisobutene.

(b) maleic anhydride or itaconic anhydride and partially esterifying the resulting copolymer with the reaction product of (A) a $C_1$–$C_{30}$-alcohol, a $C_8$–$C_{18}$-fatty acid, a $C_1$–$C_{12}$-alkyl-phenol or a secondary $C_2$–$C_{30}$-amine with (B) ethylene oxide or propylene oxide in a molar ratio of (A):(B) of from 1:2 to 1:50, the partial esterification of the copolymer being carried on until 9–30% of the carboxyl groups of the copolymer have been esterified.

3. The liquid, alkaline, detergent formulation as claimed in claim 1, wherein the partially esterified copolymer is prepared using:

(a) a mixture of 2,4,4'-trimethyl-1-pentene and 2,4,4'-trimethyl-2-pentene as the component and (b) maleic anhydride as another component.

4. The liquid, alkaline detergent formulation as claimed in claim 1, wherein the partially esterified copolymer is prepared by partial esterification with the reaction product of:

(A) a $C_1$–$C_{30}$-alcohol or a secondary $C_2$–$C_{30}$-amine with (B) ethylene oxide or ethylene oxide and propylene oxide.

5. The liquid, alkaline detergent formulation as claimed in claim 1, wherein said component (a) is one or more branched $C_6$–$C_{18}$ olefins.

6. The liquid, alkaline detergent formulation as claimed in claim 1, wherein said $C_1$–$C_{28}$-alkyl vinyl ether is selected from the group consisting of methyl vinyl ether, ethyl vinyl ether, n-propyl vinyl ether and isobutyl vinyl ether.

7. The liquid, alkaline detergent formulation as claimed in claim 1, wherein said K value of said partially esterified copolymer is from 8 to 40.

8. The liquid, alkaline detergent formulation as claimed in claim 1, wherein said $C_1$–$C_{30}$-alcohol is a mixture of more than one $C_{10}$-alcohol, $C_{13}$-alcohol, $C_{13}/C_{15}$-alcohol or $C_{16}/C_{18}$ tallow fat alcohol.

9. A liquid, alkaline detergent formulation, containing as essential constituents:

(1) about 10 to 50% by weight of one of more anionic surfactants, one or more nonionic surfactants or a mixture thereof;

(2) 0.1–20% by weight of a partially esterified copolymer obtainable by copolymerization of:

(a) one or more $C_4$–$C_{28}$-olefins or a mixture of one or more $C_4$–$C_{28}$-olefins with up to 20 mol % of a $C_1$–$C_{28}$-alkyl vinyl ether, and (b) the reaction product of (b1) an ethylenically unsaturated dicarboxylic anhydride of 4 to 8 carbon atoms and (b2) a reaction product of:

(A) a $C_1$–$C_{30}$-alcohol, a $C_8$–$C_{22}$-fatty acid, a $C_1$–$C_{12}$-alkylphenol or a secondary $C_2$–$C_{30}$-amine with (B) one or more $C_2$–$C_4$-alkylene oxides or tetrahydrofuran, in a molar ratio of (A):(B) of from 1:2 to 1:50 so that more than about 9% of the anhydride groups are esterified, in a molar ratio of (a):(b) of 1:1 to give a copolymer having a K value of from 6 to 100 and hydrolysis of the unconverted groups of the copolymer to carboxyl groups or a salt thereof; and (3) water.

10. The liquid, alkaline detergent formulation as claimed in claim 9, wherein said component (a) is one or more branched $C_6$–$C_{18}$-olefins.

11. The liquid, alkaline detergent formulation as claimed in claim 9, wherein said $C_1$–$C_{28}$-alkyl vinyl ether is selected from the group consisting of methyl vinyl ether, ethyl vinyl ether, n-propyl vinyl ether and isobutyl vinyl ether.

12. The liquid, alkaline detergent formulation as claimed in claim 9, wherein said K value of said partially esterified copolymer is from 8 to 40.

13. The liquid, alkaline detergent formulation as claimed in claim 9, wherein said $C_1$–$C_{30}$-alcohol is a mixture of more than one $C_{10}$-alcohol, $C_{13}$-alcohol, $C_{13}/C_{15}$-alcohol or $C_{16}/C_{18}$ tallow fat alcohol.

* * * * *